United States Patent [19]

Cooper

[11] Patent Number: 4,870,391

[45] Date of Patent: Sep. 26, 1989

[54] MULTIPLE FREQUENCY THEFT DETECTION SYSTEM

[75] Inventor: Michael N. Cooper, Hewlett, N.Y.

[73] Assignee: Knogo Corporation, Hauppauge, N.Y.

[21] Appl. No.: 177,939

[22] Filed: Apr. 5, 1988

[51] Int. Cl.[4] ..... G08B 13/14; H01Q 7/00

[52] U.S. Cl. ..... 340/572; 340/551; 343/868

[58] Field of Search ..... 340/551, 572, 568; 342/27, 42, 43, 44; 343/868, 866

[56] References Cited

U.S. PATENT DOCUMENTS

| | | | |
|---|---|---|---|
| 3,182,315 | 5/1965 | Sweeney | 342/44 |
| 3,500,373 | 3/1970 | Minasy | 340/572 |
| 4,023,167 | 5/1977 | Wahlstron | 343/6.5 SS |
| 4,135,183 | 1/1979 | Heltemes | 340/572 |
| 4,135,184 | 1/1979 | Pruzick | 340/572 |
| 4,274,090 | 6/1981 | Cooper | 340/572 |
| 4,321,586 | 3/1982 | Cooper et al. | 340/572 |
| 4,623,877 | 11/1986 | Buckens | 340/551 |

*Primary Examiner*—Joseph A. Orsino
*Assistant Examiner*—Thomas J. Mullen, Jr.
*Attorney, Agent, or Firm*—Fitzpatrick, Cella, Harper & Scinto

[57] ABSTRACT

A swept frequency theft detection system for detecting different resonant circuit targets which are resonant at different frequencies. The system comprises arrangements to generate swept frequency transmitter signals centered at different frequencies but which are swept in synchronism. Also provided are antennas formed by offset loops, with the loops of different frequency antennas lying along different diagonal lines.

27 Claims, 7 Drawing Sheets

164
164'
166
188
186
D/A
184
SUMMER
182
AMP AND BUFFER
178
÷ 2
180
AMP AND BUFFER
176
÷ 8
170
8MHz FILTER, AMP, DET.
168
2MHz FILTER, AMP, DET.
172
SIGNAL PROC.
174
ALARM
FROM SWEPT DRIVER 140 (FIG. 8)

MULTIPLE FREQUENCY THEFT DETECTION SYSTEM

BACKGROUND OF THE INVENTION

1. Field of the Invention

This invention relates to electronic theft detection systems (also known as electronic article surveillance apparatus); and in particular it concerns improvements for enabling such systems to interrogate and detect articles marked with targets which resonate at different frequencies.

2. Description of the Prior Art

Various techniques have been used to detect shoplifting or unauthorized removal of articles from protected areas. One of the most successful techniques, which is disclosed in now expired U.S. Pat. No. 3,500,373, involves affixing resonant circuit targets to the protected articles, generating a swept radio frequency interrogation field in the region of an exit from the protected area and detecting the occurrence of predetermined disturbances to the field caused by the passage of a resonant circuit target through the interrogation field.

As the electronic article surveillance industry has developed, different systems have been supplied which operate at different frequencies. At the present time, most resonant frequency type electronic theft detection systems operate either to detect resonant circuit targets which resonate at 2 MHZ (megahertz) or to detect resonant circuit targets which resonate at 8 MHZ. However, the 2 MHZ system cannot detect targets which resonate at 8 MHZ and the 8 MHZ system cannot detect targets which resonate at 2 MHZ. Consequently, once a proprietor of a store invests in one type of system he cannot change over to the other type unless he is willing to substitute his entire inventory of resonant circuit targets.

It has been proposed to provide separate detection systems which operate at 2 MHZ and 8 MHZ respectively. However, in order to avoid mutual interference the systems must be placed a substantial distance from each other; and the exit passageway from the store must be designed to require patrons first to pass between antenna panels of one system and thereafter to pass between antenna panels of the other system. This arrangement causes much wasted space and is inconvenient for patrons. It has also been proposed to place the two systems adjacent each other and operate them in a time sharing sequence. This proposal causes problems because the mere proximity of the transmitter antennas of the two systems produces a mutual coupling which adversely affects the interrogation signals. Further, in situations where the systems are installed along adjacent exit passageways, the systems are already time shared in order to separate the signals produced in the different passageways. Further time sharing to separate the signals produced at different frequencies would greatly reduce the durathon in which a given target is monitored and this increases the risk that it will escape detection. On the other hand, if the systems are not time shared, their respective frequency sweeps will interact and cause intermodulation components. This raises the background noise level incident on the higher frequency system; and in some cases it produces signals which are similar to those produced by a target being carried past the antenna panels. Consequently, there is a danger that the system will produce false alarms.

SUMMARY OF THE INVENTION

The present invention overcomes the above-described problems in the following ways:

According to one aspect of the invention there is provided a swept frequency theft detection system for detecting resonant circuit targets attached to articles of merchandise located in an interrogation region, the targets being resonant, respectively, at different frequencies. The system comprises means for supplying a plurality of swept frequency alternating electrical signals having different center frequencies, a plurality of transmitter antennas and a receiver. The transmitter antennas are connected respectively to receive an associated one of the supplied swept frequency signals and to produce corresponding electromagnetic waves in an interrogation region. Each of the transmitter antennas is formed of a plurality of loops offset from each other along a diagonal line. The diagonal lines of the respective transmitter antennas cross each other. The receiver is arranged to detect disturbances to the electromagnetic waves produced by the presence in the interrogation region of a resonant circuit which is resonant at a frequency within the frequency sweep of any one of the swept frequency signal and to generate an alarm response to such detection.

According to another aspect of the invention the theft detection system comprises signal generating means for generating a plurality of swept frequency alternating electrical signals centered at different frequencies and swept together in synchronism, transmitter antenna means and a receiver. The transmitter antenna means is arranged to receive the alternating electrical signals and to generate corresponding electromagnetic waves in an interrogation region. The receiver is arranged to detect disturbances to the electromagnetic waves produced by the presence in the interrogation region of a resonant circuit which is resonant within the frequency sweep of any of the alternating electrical signals and to generate an alarm in response to such detection.

In one further aspect of the invention the frequency generating means comprises a plurality of variable frequency oscillators each responsive to an applied sweep signal to shift its output frequency in accordance therewith. Each of the variable frequency oscillators has a different center frequency. There is also provided a sweep signal generator to apply sweep signals simultaneously and in synchronism to the variable frequency oscillators.

In another further aspect of the invention there is provided a swept frequency signal generator connected via a plurality of signal channels to transmitter antenna means. A frequency converter is connected along at least one of the signal channels to convert the frequencies received from the signal generator to other frequencies.

According to a still further aspect of the invention, synchronized swept frequency signals having different center frequencies are combined in a signal summing circuit and are supplied to a common transmitter.

BRIEF DESCRIPTION OF THE DRAWINGS

FIG. 3 is an exploded perspective view of an antenna panel used in the theft detection system of FIG. 1;

DETAILED DESCRIPTION OF THE PREFERRED EMBODIMENTS

Figure 1:
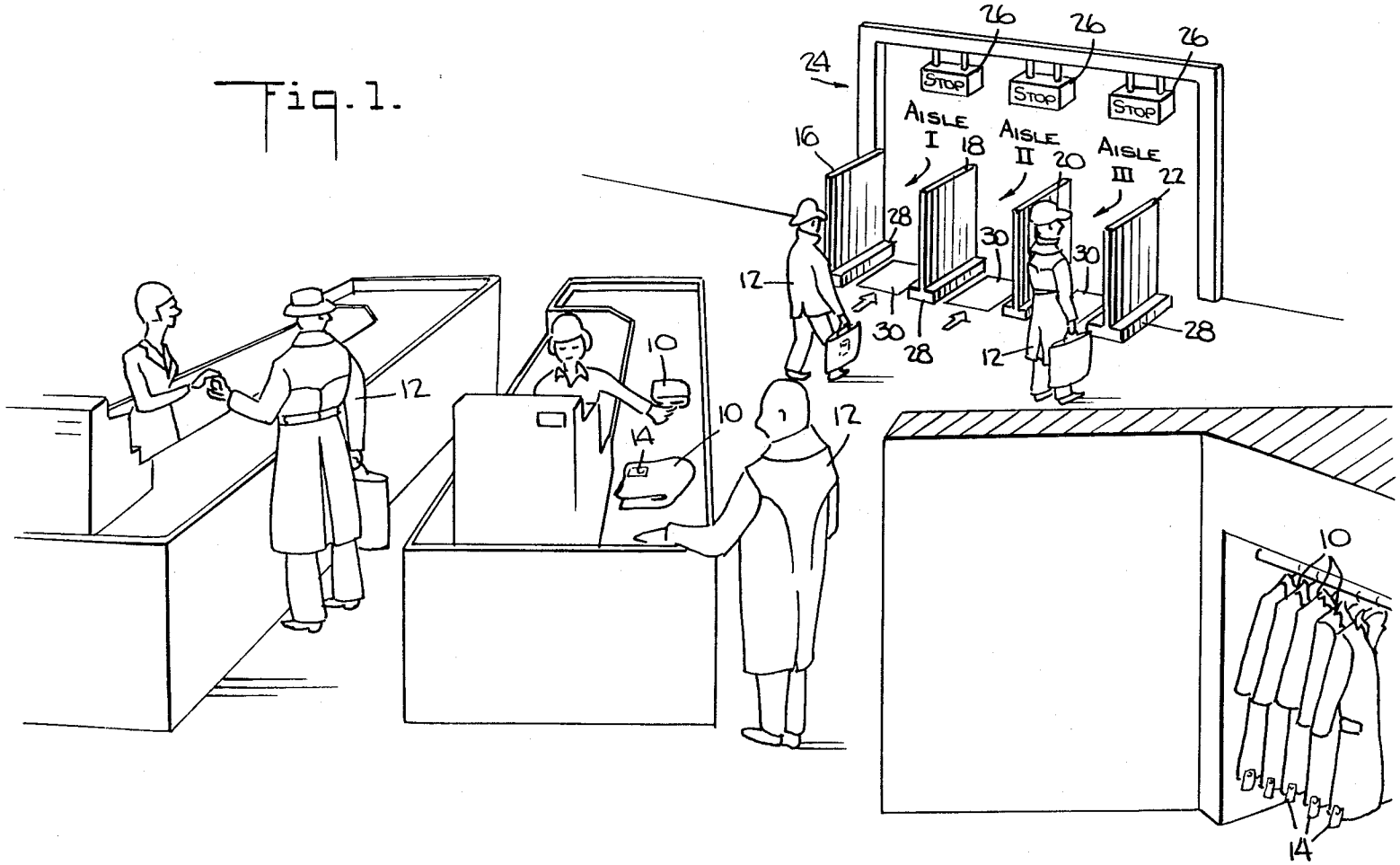
FIG. 1 is a perspective view of a store exit arranged with a dual frequency theft detection system according to the present invention.

FIG. 1 shows the interior of a store in which articles of merchandise 10 are displayed for selection and purchase by store patrons 12. Target wafers 14 are affixed to the displayed articles of merchandise in a manner such that they can be removed only by a sales clerk or other authorized person using a special tool (not shown). These target wafers each contain a resonant electrical circuit. In the present invention the different circuits may be tuned to resonate at different frequencies. In the illustrated embodiment two frequencies (i.e. 2 MHZ and 8 MHZ) are used.

If a patron 12 should attempt to take an item of merchandise 10 out of the store before the sales clerk has removed the target wafer 14, its resonant circuit will be detected by a surveillance system near the store exit and an alarm will be activated. When, on the other hand, the patron brings the merchandise to the sales clerk and pays for it, the sales clerk uses the special tool to remove the target wafer; and the patron can then take the merchandise out of the store without activating an alarm.

As can be seen in FIG. 1, a plurality of antenna panels 16, 18, 20 and 22 are positioned near an exitway 24 from the store. These antenna panels form aisles I, II and III; and each patron must pass through one or another of these aisles upon exiting from the store each patron must pass through one of these aisles. The aisles I, II and III constitute interrogation regions in which swept frequency interrogation fields of electromagnetic energy are generated. In the present embodiment two swept frequency interrogation fields are generated in each aisle. One of the fields sweeps repetitively between 1.85 and 2.15 MHZ at a rate of 330 HZ and the other field sweeps repetitively between 7.4 and 8.6 MHZ also at a rate of 300 HZ. If a target 14 which is resonant at either 2 MHZ or 8 MHZ is present in the interrogating zone, then each time one of the interrogation fields sweeps through the resonant frequency of the target, its circuit is driven into resonance and causes a distinctive disturbance to the field. This disturbance is detected and processed, and if the criteria set by the signal processing are met an alarm will be activated. By providing several adjacent aisles it is possible to identify which of several people leaving the store at the same time is carrying merchandise with a target wafer 14 attached. The aisle in which a target wafer is detected may be identified by a warning sign 26 above the aisle.

The warning sign 26 may flash or produce an audio signal. Other identifying arrangements may be used in addition to or instead of the warning signs 26.

The antenna panels 16, 18, 20 and 22 extend vertically up from pedestals 28 which rest on the floor of the store near the exitway 24. The pedestals hold the panels at the optimum height for target wafer detection. Also, the pedestals may be used to house the electronic components of the system. The leftmost antenna panel 16 contains receiver antennas. The next adjacent panel 18, across aisle I, contains transmitter antennas. The next antenna panel 20, across aisle II, contains receiver antennas; and the rightmost antenna panel 22, across aisle III, contains transmitter antennas. Each panel contains two receiver antennas or two transmitter antennas. One receiver or transmitter antenna in each panel is arranged to receive or transmit signals in the vicinity of 2 MHZ and the other is arranged to receive or transmit signals in the vicinity of 8 MHZ. On the floor of each aisle there is arranged a horizontal antenna mat 30 which contains a horizontal receiver antenna arranged to receive signals in the vicinity of 8 MHz.

In the arrangement of FIG. 1 the articles of merchandise 10 are protected by the target wafers 14 which are resonant at either 2 MHZ or 8 MHZ. If either type of wafer is carried through one of the aisles I, II or III it will cause a alarm corresponding to that aisle to be activated.

Figure 2:
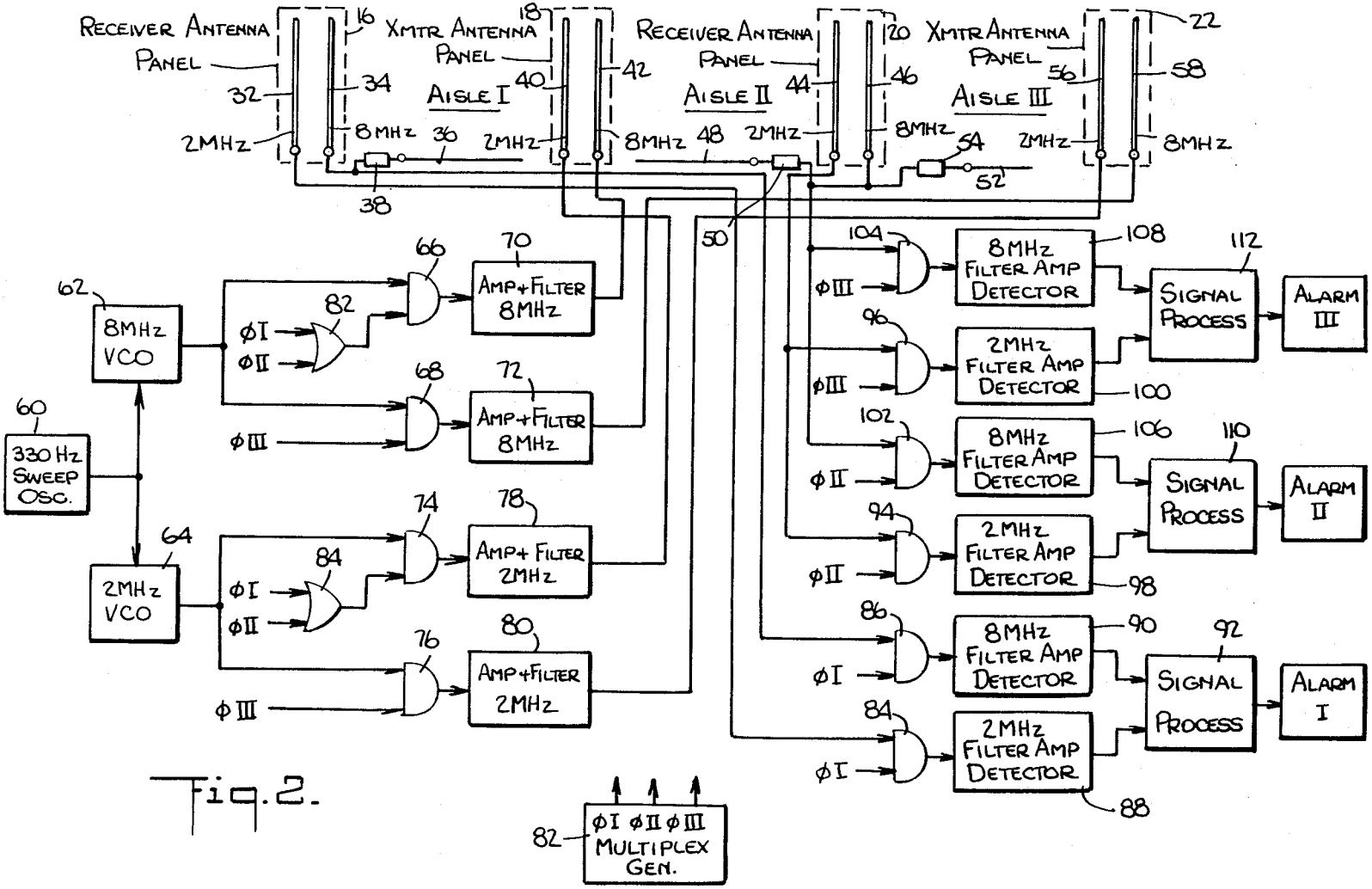
FIG. 2 is a schematic and block diagram of the electronic portion of the theft detection system of FIG. 1.

FIG. 2 shows in block diagram form the electronic arrangement for the detection system of FIG. 1. The details of the individual components are not essential to the invention and are not described herein. However, those details may be found in U.S. Pat. No. 4,321,586.

As shown in FIG. 2, the receiver antenna panel 16 contains a 2 MHZ receiver antenna 32 and an 8 MHZ receiver antenna 34. In addition, a horizontal 8 MHZ receiver antenna 36 extends across the floor of aisle I and is connected, via a coupling 38, to the 8 MHZ receiver antenna 34. The transmitter antenna panel 18 contains a 2 MHZ transmitter antenna 40 and an 8 MHZ transmitter antenna 42. The receiver antenna panel 20 contains a 2 MHZ receiver antenna 44 and an 8 MHZ receiver antenna 46. In addition a horizontal 8 MHZ receiver antenna 48 extends across the floor of aisle II and is connected via a coupling 50 to the 8 MHZ receiver antenna 44. Also a further horizontal 8 MHZ receiver antenna 52 extends across the floor of-aisle III and is connected via a coupling 54 to the 8 MHZ received antenna 44. The transmitter antenna panel 22 contains a 2 MHZ transmitter antenna 56 and an 8 MHZ transmitter antenna 58. The horizontal receiver antennas 36, 48 and 52 are embedded in the horizontal antenna mats 30 (FIG. 1).

In operation of the system as thus far described, the system is activated for only one aisle at a time. Thus the aisles are scanned in sequence. The scanning is done quite rapidly, e.g. several times per second so that a person cannot walk through any aisle without that aisle having been activated a number of times. By sequentially scanning the aisles it is possible to ascertain which aisle a target wafer was carried through. This idea of sequential scanning several aisles to identify the aisle location of a detected target is described in detail in U S. Pat. Nos. 4,274,090 and 4,321,586.

In the arrangement of FIG. 2 each aisle is activated for detection of both 2 MHZ and 8 MHZ target wafers at the same time. This simultaneous operation of the system in both the 2 MHZ and the 8 MHZ modes enables each aisle to be scanned for the maximum amount of time.

Referring now to FIG. 2, aisle I is activated by energizing both the 2 MHZ and the 8 MHZ transmitter antennas 40 and 42 in the transmitter antenna panel 18 and, at the same time, connecting both the 2 MHZ and the 8 MHZ receiver antennas 32 and 34 in the receiver antenna panel 16, as well as the 8 MHZ horizontal antenna 36, for detection of signals received thereat. Aislle I is maintained activated for a duration of approximately 8.3 milliseconds.

At the end of the 8.3 milliseconds interval during which aisle I was activated, that aisle is deactivated and aisle II is attivated. This is done by disconnecting the 2 MHZ and 8 MHZ receiver antennas 32, 34 and 36 and connecting the 2 MHZ and 8 MHZ receiver antennas 44, 46 and 48 for detection of signals received thereat. It will be noted that the transmitter antennas 40 and 42 transmit in the directions of both aisle I and aisle II and therefore remain energized for the detection of target wafers 14 in aisle II.

After aisle II has been activated for a predetermined interval, e.g. 8.3 milliseconds, it is deactivated and aisle III is activated. This is done by deenergizing the transmitter antennas 40 and 42 and energizing the 2 MHZ and 8 MHZ transmitter antennas 56 and 58 in the transmitter antenna panel 58 and by connecting the outputs of the receiver antennas 44, 46 and 52 so that their outputs during this interval activate aisle III alarm.

The above described sequence of alternate activation of aisles I, II and III is repeated continuously.

The arrangements for successively energizing the transmitter antennas and for successively directing the outputs of the receiver antennas to appropriate detectors and alarm activators will now be described.

As shown in FIG. 2, there is provided a common sweep oscillator 60 which generates an electrical voltage output whose value varies repetitively in a predetermined pattern, e.g. as a sine wave, and at a predetermined frequency e.g. 330 HZ (hertz). This electrical signal is applied simultaneously and in synchronism to the frequency control input of an 8 MHZ voltage controlled oscillator (VCO) 62 and a 2 MHZ VCO 64. This sweep oscillator 60 causes the 8 MHZ VCO to produce an electrical output which varies in frequency between 7.4 MHZ and 8.6 MHZ (centered at 8.0 MHZ) at a 330 HZ rate; and it causes the 2 MHZ VCO to produce an electrical output which varies in frequency between 1.85 MHZ and 2.15 MHZ (centered at 2.0 MHZ). also at a 330 HZ rate. The frequency sweeps of both the 8 MHZ and the 2 MHZ VCOs are maintained in synchronism. More particularly, the phase of the sweep of each VCO is maintained such that they both produce an increasing frequency at the same time and they both produce a decreasing frequency at the same time. This synchronized sweep frequency control serves to prevent generation of intermodulation frequency components which appear as undesirable high background noise or, in some cases, as false targets.

The output of the 8 MHZ VCO 62 is applied in parallel to two 8 MHZ transmitter AND gates 66 and 68, and from each AND gate to associated amplifiers and filters 70 and 72. These amplifiers and filters produce a high amplitude (e.g. 100 volts peak to peak) swept frequency signal which is essentially free of undesirable harmonics and other unwanted frequency components. The output of the amplifiers and filters 70 is applied to the 8 MHZ antenna 42 in the transmitter antenna panel 18; and the output of the amplifiers and filters 72 is applied to the 8 MHZ antenna 58 in the transmitter antenna panel 22.

The output of the 2 MHZ VCO 64 is applied in parallel to two 2 MHZ transmitter AND gates 74 and 76 and from each AND gate to associated amplifiers and filters 78 and 80, which also produce a high amplitude (e.g. 100 volts peak to peak) swept frequency signals which are essentially free of undesirable harmonics and other unwanted frequency components. The output of the amplifiers and filters 78 is applied to the 2 MHZ antenna 40 in the transmitter antenna panel 18 and the output of the amplifiers and filters 80 is applied to the 2 MHZ antenna 56 in the transmitter antenna panel 22.

A multiplex generator 82 is provided which generates switching signals for controlling the sequence of transmitter and receiver activation at each of the aisles I, II and III. The multiplex generator, which may comprise a clock pulse generator and a counter, produces a voltage on each of three output terminals $\phi$I, $\phi$II and $\phi$III in succession. These voltages should have sufficient duration to enable the system to detect and respond to a target present in the aisle for which the associated transmitter and receiver are activated and yet the duration should be short enough to ensure that the transmitter and receiver is activated for all three aisles within the time it takes for a patron to pass through an aisle. It is preferred that the voltages, $\phi$I, $\phi$II and $\phi$III each have a duration of about 8.3 milliseconds.

The voltage $\phi$I and $\phi$II are applied via an OR gate 82 to an input of the AND gate 66. The voltage $\phi$I and $\phi$II are also applied via an OR gate 84 to input of the AND gate 74. The voltage $\phi$III is applied to an input of each of the AND gates 68 and 76. Whenever one of the voltages, $\phi$I, $\phi$II and $\phi$III is applied to an input of one of the AND gates 66, 68, 74 and 76, that gate will permit the swept frequency signal from its associated VCO 62 and 64 to be amplified, filtered and applied to energize its associated transmitter antenna 42, 58, 40 or 56. Thus it will be seen that during the occurrence of each of the voltages $\phi$I and $\phi$II, both the 2 MHZ and the 8 MHZ antennas 40 and 42 in the transmitter antenna panels between aisles I and II are energized; and during the occurrence of the voltage $\phi$III both the 2 MHZ and the 8 MHZ antennas 56 and 58 in the transmitter antenna panel adjacent aisle III are energized.

The 2 MHZ and 8 MHZ receiver antennas 32 and 34 in the receiver antenna panel 16 are connected, respectively, via AND gates 84 and 86 to associated 2 MHZ and 8 MHZ filter, amplifier and detector circuits 88 and 90. These filter, amplifier and detector circuits suppress signals from their respective antennas which are not in the range of 2 MHZ and 8 MHZ respectively; and they amplify the remaining signals and detect the modulation components of those signals as well as any disturbances produced by the presence of resonant circuit targets in the aisle. The detected signal components and disturbances are then processed in an aisle I signal processor 92. If the characteristics of the signals applied to the signal processor 92 meet the criteria set therein for detection of an 8 MHZ or a 2 MHZ resonant circuit target in aisle I, the processor 92 will apply an energization signal to energize an associated alarm I, which may for example be the warning light 26 (FIG. 1) above aisle I.

The 2 MHZ receiver antenna 44 in the receiver antenna panel 20 is connected in parallel via AND gates 94 and 96 to associated aisle II and aisle III 2 MHZ filter, amplifier and detector circuits 98 and 100. Also, the 8 MHZ receiver antenna 58 in the receiver antenna panel 20 is connected in parallel via AND gates 102 and 104 to associated aisle II and aisle III 8 MHZ filter, amplifier and detector circuits 106 and 108. The signals detected by the aisle II 2 MHZ and 8 MHZ filter amplifier and detector circuits 98 and 106 are processed in an aisle II signal processor 110; and if they meet the criteria set therein for detection of an 8 MHZ or 2 MHZ resonant circuit target in aisle II, the signal processor 110 will energize an aisle II alarm. Similarly, the signals detected by the aisle III 2 MHZ and 8 MHZ filter amplifier and detector circuits 100 and 108 are processed in an aisle III signal processor 112; and if they meet the criteria set therein for detection of an 8 MHZ or a 2 MHZ resonant circuit target in aisle III, the signal processor will energize an aisle III alarm. The aisle II alarm and the aisle III alarm may also be one of the warning lights 26 associated with the respective aisles.

The voltage $\phi$I from the multiplex generator 82 is applied to one input of each of the AND gates 84 and 86. Also, the voltage $\phi$II is applied to one input of each of the AND gates 94 and 102 and the voltage $\phi$III is applied to one input of each of the AND gates 96 and 104. It will be appreciated from the foregoing that during the $\phi$I interval the 2 MHZ and the 8 MHZ antennas 40 and 42 in the transmitter antenna panel 18 are energized and both the 2 MHZ and the 8 MHZ antennas 32 and 34 in the receiver antenna panel 16 across aisle I are connected to their associated filter, amplifier and detector circuits 88 and 90. Also, since the horizontal floor antenna 36 in aisle I is connected to the 8 MHZ receiver antenna 34, it too is connected to the filter, amplifier and detector circuits 90 during the $\phi$I interval. Thus, during the $\phi$I interval the antennas on both sides and on the floor of aisle I are activated. Although the 2 MHZ and the 8 MHZ transmitter antennas 40 or 42 transmit into aisle II during the $\phi$I interval, the receiver antennas 44 and 46 across this aisle and the horizontal antenna 48 on the floor of the aisle are not connected to their associated filter amplifier and detector circuits 98, 100, 106 and 108; and therefore a resonant circuit target in aisle II will not be detected during the $\phi$I interval. Also since none of the antennas on either side on the floor of aisle III is operational during the $\phi$I interval a resonant circuit target in aisle III will not be detected during the $\phi$I interval.

During the $\phi$II interval, the 2 MHZ and its 8 MHZ antennas 40 and 42 in the transmitter antenna panel 18 continue to be energized. During the $\phi$II interval, however, the receiver antennas 32, 34 and 36 across aisle I are not connected to energize their associated filter, amplifier and detector circuits 88 and 90 but the receiver antennas 20 and 44 across aisle II, and the horizontal antenna 48 on the floor of aisle II are connected to their associated filter, amplifier and detector circuits 98 and 106 and therefore if a resonant circuit target is present in aisle II during the interval $\phi$II it will be detected. Since the antennas 56 and 58 in the transmitter antenna panel 22 are not energized during the $\phi$II interval, a target present in aisle III will not cause any disturbance in the electromagnetic fields applied to the receiver antennas 44, 46, 48 or 52 and therefore will not be detected.

During the $\phi$III interval, only the 2 MHZ and 8 MHZ transmitter antennas 56 and 58 in the transmitter antenna panel 22 are energized and the 2 MHZ and 8 MHZ transmitter antennas 44 and 46 in the receiver antenna panel 20 across aisle III and the horizontal antenna 52 and the floor of aisle III are connected to associated filter, amplifier and detector circuits 100 and 108. Consequently only resonant circuit targets in aisle III will be detected during the interval $\phi$III. Although the horizontal antenna 48 in aisle II is connected to the filter, amplifier and detector circuit 108 during the $\phi$III interval, this does not result in the detection of a resonant circuit target in aisle II because no 8 MHZ interrogation field is produced in aisle II during the $\phi$III interval.

FIG. 3 shows the general construction of the antenna panels 16, 18, 20 and 22. As shown, these panels comprise a supporting frame 120 of an insulative material, such as wood or plastic, which is formed with grooves 122 or other arrangements for supporting a pair of conductive wire loops **124*a* and 124*b* on one side and 126*a* and 126*b* on the opposite side. The loops 124*a* and 124*b* form an 8 MHZ transmitter or receiver antenna; and the loops 126 form a 2 MHZ transmitter or receiver antenna. The loops 124*a* and 124*b* are rectangular in shape and are diagonally offset from one another i.e. in both the horizontal and vertical directions. The loops 126*a* and 126*b* are also rectangular in shape and are diagonally offset from one another but in a direction opposite to that of the loops 124*a* and 124*b*. Thus the lower 8 MHZ loop 124*a* is closer to the exit than the higher 8 MHZ loop 124 but the lower 2 MHZ loop 126*a* is further from the exit than the higher 2 MHZ loop 126*b***.

By providing two transmitter antenna loops of generally rectangular shape which are mutually offset from one another in a diagonal direction it is possible to generate interrogation fields which are most effective to produce reactions from target wafers which are carried at various orientations and along various paths through the aisle.

Although the antenna loops are shown to be fully offset in the horizontal direction and only partially offset in the vertical direction, they can be partially or fully offset in either or both directions.

By choosing the offset to be along different diagonal directions for the 2 MHZ and the 8 MHZ antennas it is possible to minimize coupling between the transmitter antennas, which would otherwise reduce their Q and prevent generation of maximum fields at their respective frequencies. The 2 MHZ and 8 MHZ receiver antenna loops are chosen to have the same diagonal offsets as their respective transmitter antenna loops. This permits maximum balance and efficiency. Also, where several sets of transmitter antennas are arranged along adjacent aisleways, the diagonal offsets of the loops of the antennas of the same frequencies should be the same.

The supporting frame 120 in FIG. 3 is shown to have rectangular cutouts **120*a*** within the various antenna loops. These cutouts are merely provided for aesthetic reasons and are not necessary for the operation of the antenna.

FIGS. 4–7 show the circuit diagrams for the 8 MHZ transmitter antennas 42 and 58, the 8 MHZ vertical and horizontal receiver antennas 34, 46, 48 and 52, the 2 MHZ transmitter antennas 40 and 46 and the 2 MHZ receiver antennas 32 and 44.

Figure 4:
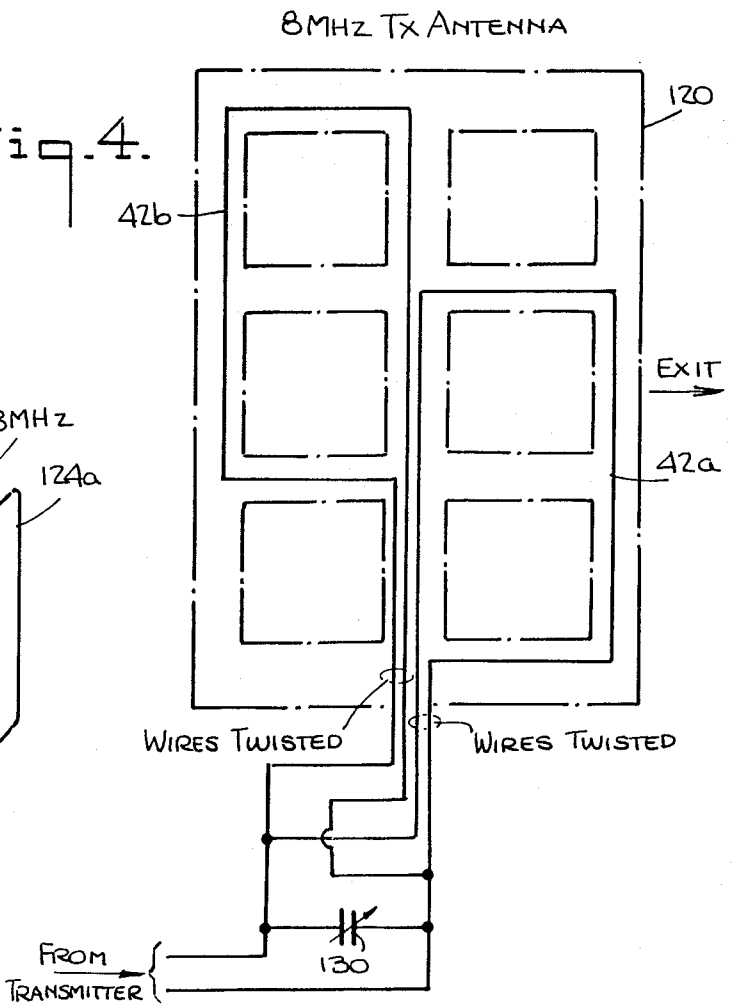
FIGS. 4–7 are wiring diagrams for the various antenna panels in FIG. 1.

As shown in FIG. 4, the 8 MHZ transmitter antenna, which may be the antenna 42 or the antenna 58, comprises a first rectangular loop **42*a* which occupies the lower two thirds and the half of the frame 120 closest to the exit and a second rectangular loop 42*b* which occupies the upper two thirds and the half of the frame 120** away from the exit.

The diagonal of offset of the 8 MHZ transmitter antenna loops **42*a* and 42*b* is thus downward toward the exit. The wires extending from each of the loops 42*a* and 42*b*** are, in actual practice, twisted together to prevent undesired radiation. This twisting of the wires is symbolized in the drawings by rings surrounding the wires.

The loops 42*a* and 42*b* are one turn each and are connected to each other in parallel in such a manner that electrical currents from the 8 MHZ transmitter always flow in the same direction in both loops. A capacitor 130 is connected in parallel with the loops 42*a* and 42*b*.

In the preferred arrangement each loop has a width of 8 inches (20.32 cm) and a height of 30 inches (76.2 cm). Each loop has an inductance of 2.6 μH (microhenries). The capacitor 130 is set to a value of 300 pf (picofarads) so that the loops 46*a* and 46*b* and the capacitor 130 form a resonant circuit which is resonant at 8 MHZ. This resonant circuit transmitter antenna arrangement permits the transmitter to generate maximum electromagnetic interrogation energy in the aisle while using minimum power.

Figure 5:
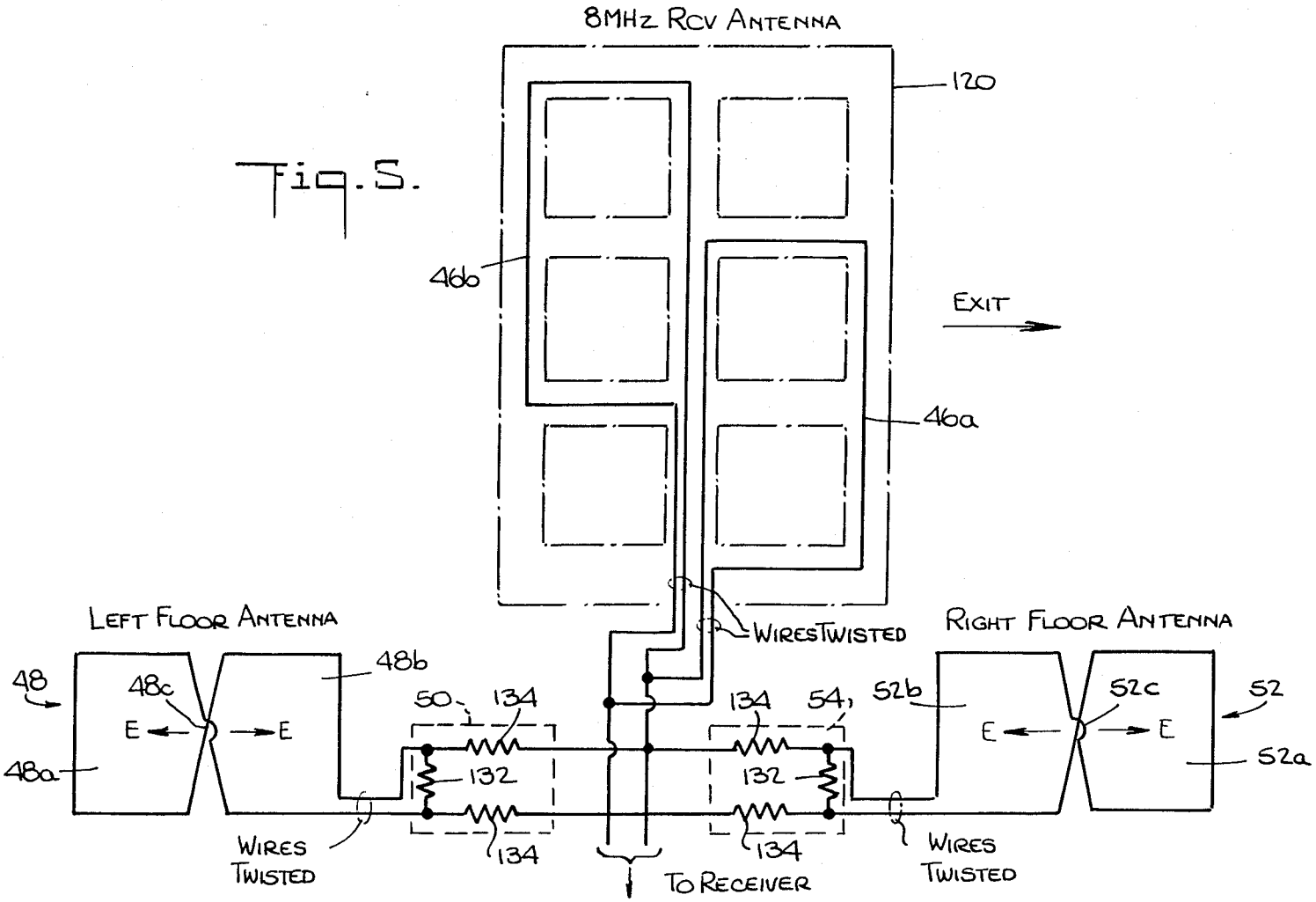

As shown in FIG. 5, the 8 MHZ receiver antenna, which may be the antenna 44 or the antenna 46, is formed of two rectangular single turn loops 46*a* and 46*b* of the same size, and with the same diagonal offset, i.e. downward toward the exit, as the loops 42*a* and 42*b* of the 8 MHZ transmitter antenna 42. As shown in FIG. 5, however, the loops 42*a* and 42*b* are connected in parallel but in a manner such that-electromagnetic fields incident on both loops will produce currents in opposite directions in the two loops. Thus, remotely generated electromagnetic fields, which are incident in substantially equal amounts on both loops, are cancelled; however electromagnetic disturbances produced by a resonant circuit target carried past the loops will nearly always originate closer to one loop than the other and will produce an unbalanced condition in the loops which can easily be detected.

The horizontal floor antennas 48 and 52 are connected in parallel via their respective coupling circuits 50 and 54 to the loops 46*a* and 46*b*. The floor antennas 48 and 52 each comprise two series connected single turn loops 48*a* and 48*b* and 52*a* and 52*b* of figure-eight configuration. The crossover point of the loops of these antennas (shown at 48*c* and 52*c*) is adjustable as indicated by the arrows E for balancing as will be explained more fully hereinafter.

The coupling circuits 50 and 54 each comprise a termination resistor 132 connected across the loop leads as well as a coupling resistor 134 connected in series along each of the loop leads. The termination resistor 132 is set to match the impedance of the horizontal floor antenna 48 or 52 to the combination of the vertical antenna and receiver and is in the region of about 100 ohms. The coupling resistors 134 are set to adjust the relative sensitivity of the horizontal and vertical antennas and are generally each in the region of about 1,000 ohms.

The construction and arrangement of the coupling circuit 38 in aisle I is the same as the coupling circuits 50 and 54 in aisles II and III.

Figure 6:
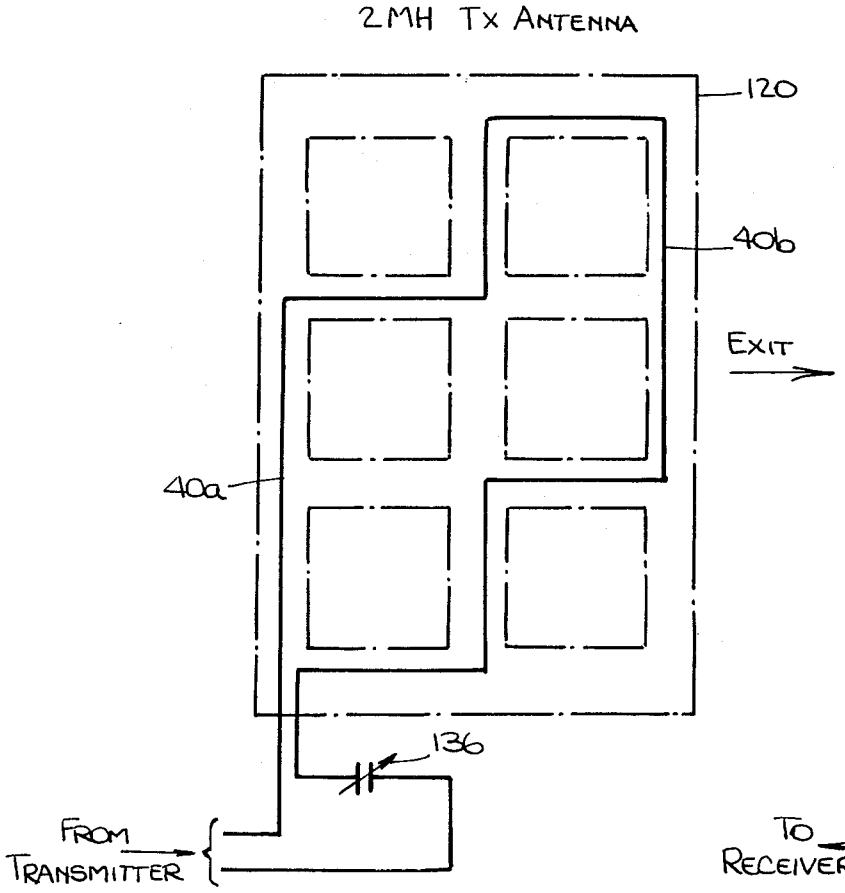

The 2 MHZ transmitter antenna shown in FIG. 6, which may be the antenna 40 or the antenna 56, comprises a first rectangular loop 40*a* which occupies the lower two thirds and the half of the frame 120 away from the exit and a second rectangular loop 40*b* which occupies the upper two thirds and the half of the frame 120 closest to the exit. The diagonal of offset of the 2 MHZ transmitter antenna loops 40*a* and 40*b* thus is upward toward the exit, i.e. opposite to that of the 8 MHZ transmitter antenna loops 42*a* and 42*b*.

As shown in FIG. 6 the loops 40*a* and 40*b* are one turn each and are connected in series in such a manner that electrical currents from the 2 MHZ transmitter always flow in the same direction in both loops. A capacitor 136 is connected across the loops 40*a* and 40*b*. In the preferred arrangement the loops 42*a* and 42*b* each has a width of 8 inches (20.32 cm) and a height of 30 inches (76.2 cm). Since the loops are not fully offset one from the other in the vertical direction the loops may be open in the region of mutual overlap. The total inducance of the two series connected loops is 5.2 μH and the capacitor 136 is set to 1218 pf to form a resonant circuit which is resonant at 2 MHZ This enables the antenna to produce maximum electromagnetic energy in the aisle while using minimum power for maximum output signal with minimum power.

Figure 7:
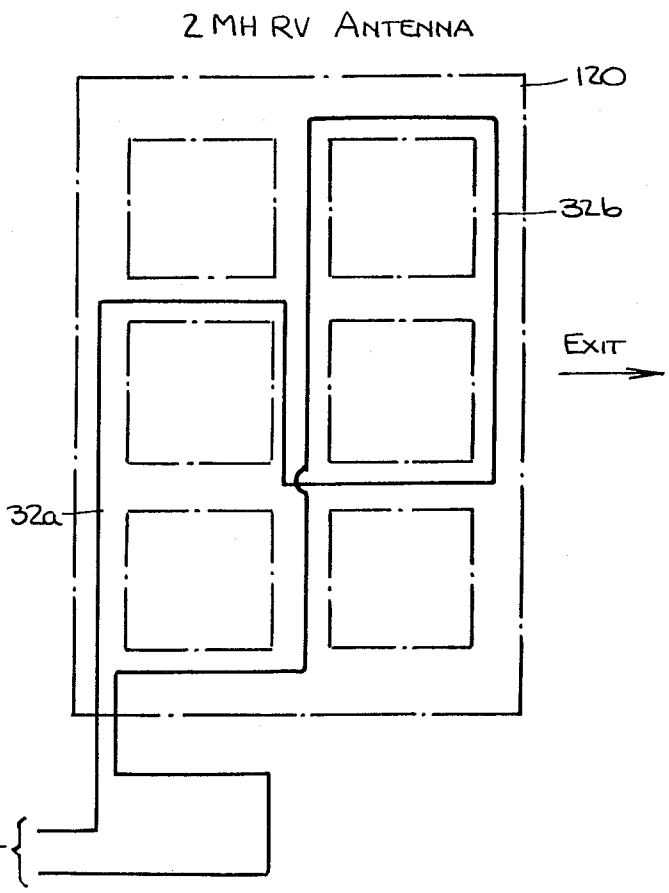

The 2 MHZ receiver antenna shown in FIG. 7, which may be the antenna 32 or the antenna 44 is formed of two rectangular single turn loops 32*a* and 32*b* of the same size and with the same diagonal offset, i.e. upward toward the exit, as the loops 40*a* and 40*b* of the 2 MHZ transmitter antenna 40. As shown in FIG. 7, the loops 40*a* and 40*b* are connected in series but in a manner such that a common electromagnetic field incident on both loops will produce currents in opposite directions in the two loops.

The 2 MHZ transmitter and receiver antennas are set up in alignment with each other so that the fields generated by the transmitter antenna have equal effect on the two loops of the receiver antenna. Thus, in the absence of a resonant circuit target in the aisle, the transmitter signals are essentially balanced in the receiver antenna loops and no alarm is produced. However when a resonant circuit target is present in the aisle, it is usually closer to one of the receiver antenna loops than the other so that the disturbances caused by the target are stronger at one receiver antenna loop than the other. As a result a finite detectable disturbance signal is produced at the receiver.

In case sufficient balance of the receiver loops cannot be achieved by their positioning and dimensioning alone, it is possible to produce the necessary balance by applying a minute amount of transmitter output in proper phase to the receiver input.

The 8 MHZ receiver antennas can be balanced in the same manner as the 2 MHZ receiver antennas. However it is generally not necessary to couple transmitter power to the receiver to achieve final balance because this can be done by adjusting the position of the crossovers 48*c* and 52*c* of the loops of the horizontal antennas 48 and 52. This is illustrated by the arrows E in FIG. 5.

The horizontal antennas 36, 48 and 52 are used only in the 8 MHZ system. Those antennas are arranged to respond to signals produced by resonant circuit targets which have been affixed to shoes to protect against theft by patrons who attempt to take them out of a store by trying them on and walking out while wearing them. Generally a resonant circuit target which is resonant at 8 MHZ is smaller and therefore more suited for attachment to shoes then a resonant circuit target which is resonant at 2 MHZ.

Figure 8:
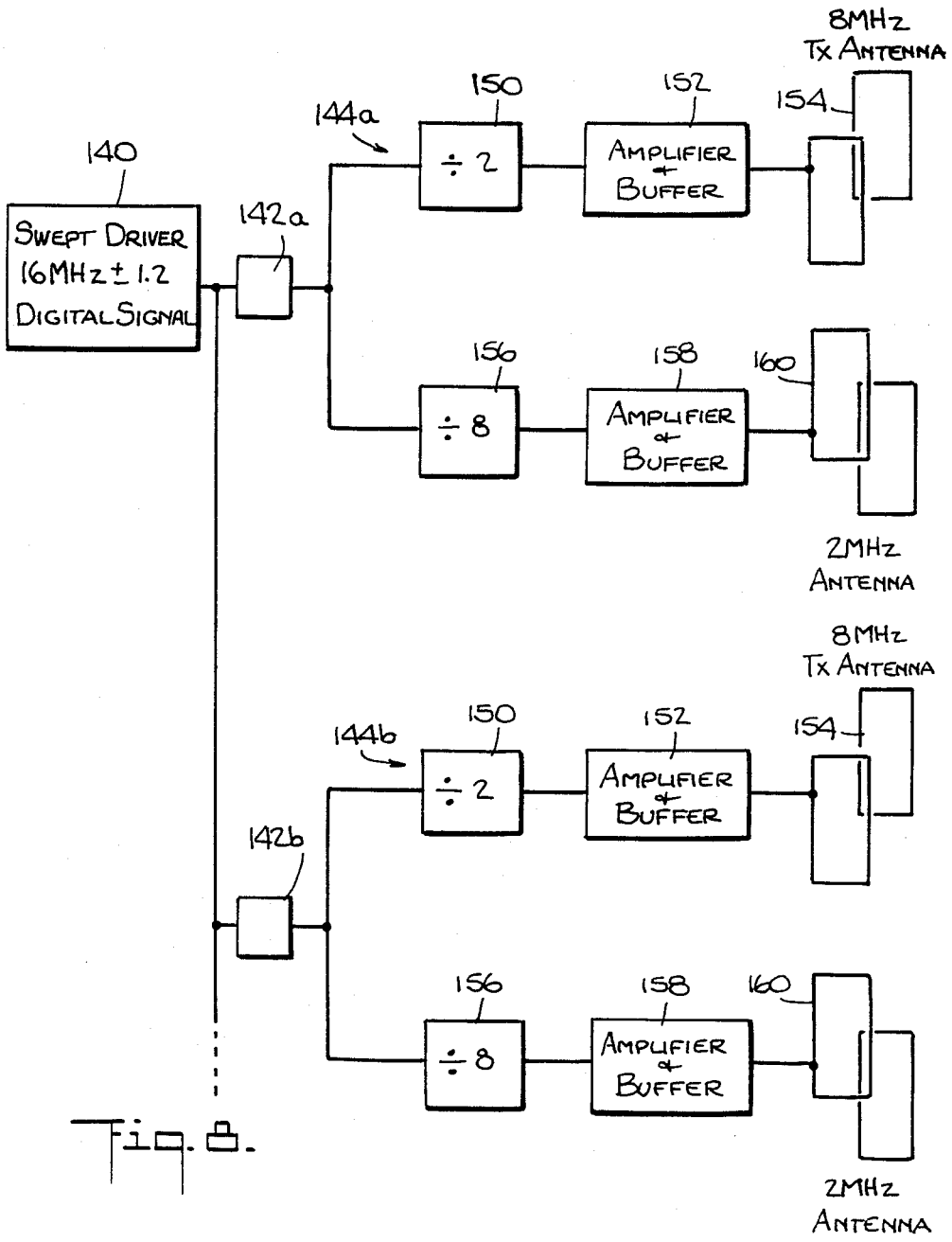
FIG. 8 is a block diagram of the transmitter portion of an alternate embodiment of the invention.
Figure 9:
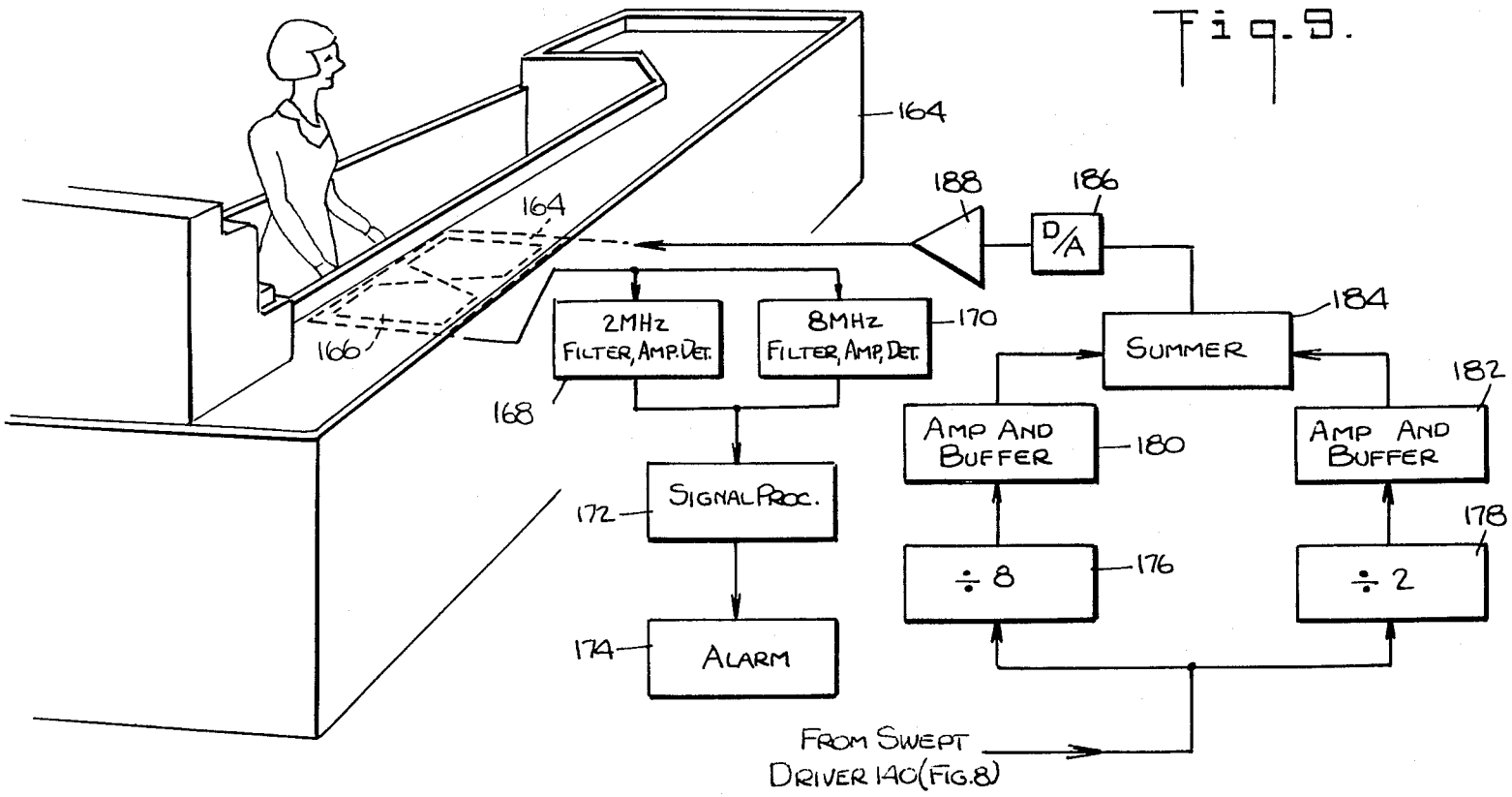

FIG. 8 shown another arrangement for energizing the 8 MHZ and 2 MHZ transmitter antennas in several adjacent aisles without producing interfering signals. As shown in FIG. 8, there is provided a swept driver 140 which produces a digital output at a frequency which sweeps repetitively between 14.8 MHZ and 17.2 MHZ at rate of 330 HZ. The driver 140 may be a Motorola 1648 VCO (voltage controlled oscillator) using TTL (Transistor-Transistor-Logic). The output from the swept driver is applied via multiplex switches 142a, 142b, etc., to transmitter units 144a, 144b, etc in the various aisles.

Each transmitter unit includes a 2 MHZ channel and an 8 MHZ channel. The 8 MHZ channel comprises a divide by two divider 150 which changes the signal from the driver 140 to a digital signal at a frequency which sweeps repetitively between 7.4 and 8.6 MHZ at a rate of 330 HZ. The divider output is then amplified in an amplifier and buffer circuit 152 and applied to an 8 MHZ transmitter antenna circuit 154. The antenna circuit is a resonant circuit as previously described and serves to convert the digital swept frequency signal to a analog signal for energizing the antenna loops.

The 2 MHZ channel comprises a divide by 8 divider 156 which changes the signal from the driver 140 to a digital signal at a frequency which sweep repetitively between 1.85 and 2.15 MHZ at a rate of 330 HZ. The divider output is amplified in an amplifier and buffer circuit 158 and applied to a 2 MHZ antenna circuit 160. The digital dividers 150 and 156 and the amplifier and buffer circuits 152 and 158 are conventional and the specific design used is not critical to the invention.

The signals from the driver 140 are applied to each of the transmitter units and since the signals are digital they are maintained in precise synchronism in all units in each frequency channel within each unit. Therefore the system is maintained free of intermodulation components, which may cause undesirably high noise levels or false target indications.

The receiver and receiver antenna portion of the system shown in FIG. 8 is the same as in FIGS. 2, 5 and 7.

Figure 9:
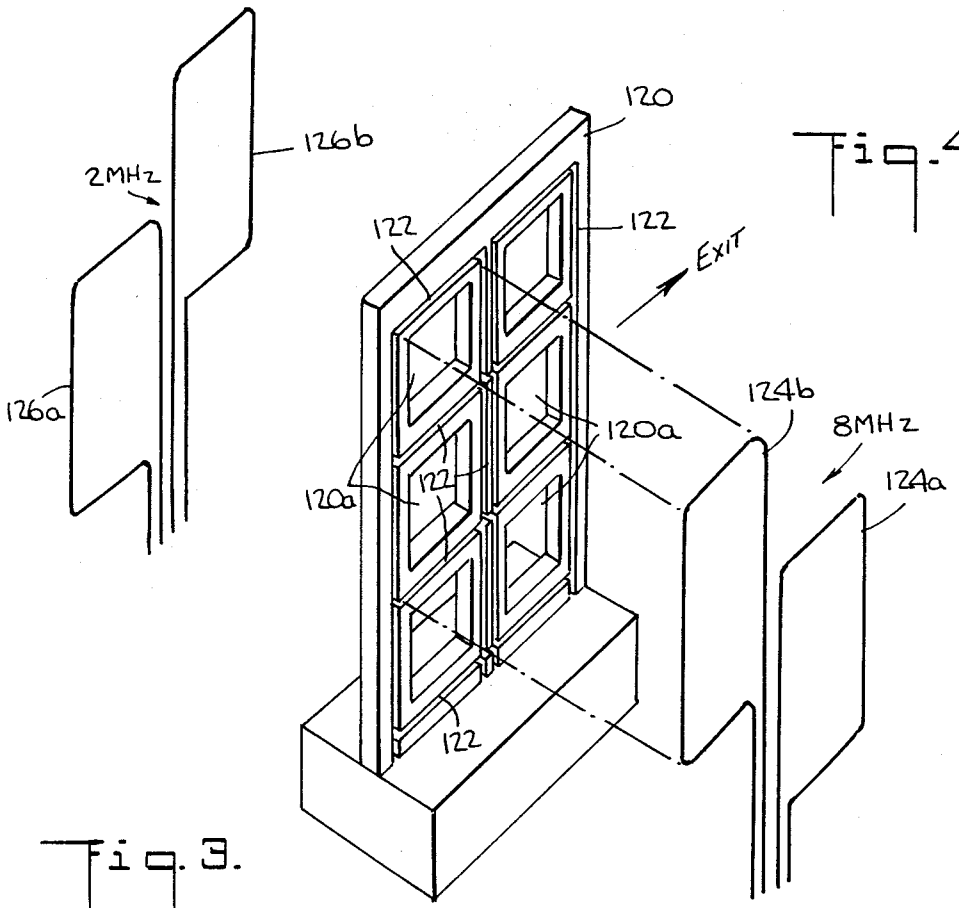
FIG. 9 is a perspective and block diagram of an embodiment of the present invention as used in a wrap desk.

FIG. 9 shows how the invention may be applied to a "wrap desk". A wrap desk is a table or a counter where merchandise is placed while it is being checked and wrapped or packaged by the sales clerk. The antenna arrangement in FIG. 9 is built into the wrap desk and is connected to a detection and alarm system to detect the presence of a resonant circuit target which the sales clerk may have forgotten to detach from the merchandise. Thus the wrap desk detection arrangement provides a reminder to the clerk to remove the wafer.

As shown in FIG. 9 there is provided a wrap desk 162 having embedded in its upper surface a single or multiple turn, single loop transmitter antenna 164 surrounding a single or multiple turn, figure-eight loop receiver antenna 166. The receiver antenna is connected to 2 MHZ filter, amplifier and detector circuits 168 and to 8 MHZ filter amplifier and detector circuits 170. These circuits operate to detect electromagnetic disturbances which occur in the vicinity of 2 MHZ and 8 MHZ respectively. Thus the wrap desk 162 is set up to provide a reminder warning if either a 2 MHZ or an 8 MHZ resonant circuit target has not been removed by the sales clerk.

The outputs of the 2 MHZ and 8 MHZ filter, amplifier and detector circuits are applied to a common signal processing circuit 172 which processes the detected signals to see whether they conform to predetermined criteria corresponding to the presence of a 2 MHZ or an 8 MHZ resonant circuit target on the wrap desk 162. When such target is detected the signal processing circuit produces an output signal which actuates an alarm 174.

The wrap desk transmitter antenna 164 is connected to be energized simultaneously at a first swept frequency centered at 2 MHZ and at a second swept frequency centered at 8 MHZ. As in the case of the preceeding embodiments the frequency sweeps in the 2 MHZ range and in the 8 MHZ range are synchronized so that they both increase and decrease in frequency at the same time. As explained above this frequency sweep coordination prevents the generation of intermodulation components which may otherwise produce high levels of ambient noise or even false target representations.

Since the same transmitter antenna 164 simultaneously transmits widely diverse frequencies, the antenna is not connected with a capacitor to form a resonant frequency circuit. Instead the transmitter antenna 164 is directly driven at each frequency. Although such direct driving of a single non-resonant antenna requires considerably more power than needed to drive a resonant antenna, this is not a problem in the case of the wrap desk application because the targets to be detected on a wrap desk are lying directly on the wrap desk and can be detected with low transmitted power.

As shown in FIG. 9, a digital swept frequency signal of 14.8 to 17.2 MHZ is provided, preferably from the swept driver 140 (FIG. 8) which supplies other transmitters. This assures synchronism of the transmitted signals at the wrap desk with the transmitted signals at the various exit aisles. The swept digital signal is applied to both a divide by eight divider 176 and a divide by two divider 178. The divider outputs are amplified in associated amplifier and buffer circuits 180 and 182 and the outputs of these circuits are combined in a summer 184. The summer output is converted to analog form in a digital to analog converter 186 and the converter output is amplified in an amplifier 188 and applied to the transmitter antenna 164.

It will be appreciated from the foregoing that the arrangements of the present invention permit the detection of resonant circuit target which resonate at widely different frequencies with minimal intercoupling between transmitter antennas and with minimal generation of noise or false target signals.

I claim:

1. A swept frequency detection system for detecting resonant circuit targets attached to articles of merchandise located in an interrogation region, said targets being resonant, respectively, at different frequencies, said system comprising means for supplying, simultaneously, a plurality of swept frequency alternating electrical signals centered, respectively, at different frequencies, a plurality of transmitter antennas connected respectively, to receive an associated one of said alternating electrical signals centered at an associated one of said different frequencies and to produce corresponding electromagnetic waves, simultaneously, in an interrogation region, each transmitter antenna being formed in a plurality of loops offset from each other along a diagonal line such that the loops along each diagonal line produce electromagnetic waves centered about an associated one of said different frequencies, the diagonal lines of the respective transmitter antennas crossing each other, and a receiver arranged to detect disturbances to said electromagnetic waves produces by the presence in said interrogation region of a resonant circuit which is resonant within the frequency sweep of any of said alternating electrical signals.

2. A swept frequency detection system according to claim 1 wherein said transmitter antennas are mounted on a common support frame.

3. A swept frequency detection system according to claim 1 wherein said loops are rectangular in shape.

4. A swept frequency detection system according to claim 1 wherein said system includes a plurality of interrogation regions with associated transmitter antennas and wherein the corresponding loops of different transmitter antennas which produce the same frequencies are aligned with each other.

5. A swept frequency detection system according to claim 4 wherein said receiver includes a plurality of receiver antennas for receiving signals generated by corresponding ones of said transmitter antennas, said receiver antennas being shaped the same as, and in alignment with, their respective transmitter antennas.

6. A swept frequency detection system according to claim 1 wherein said receiver means includes a plurality of receiver antennas for receiving signals generated by corresponding ones of said transmitter antennas, said receiver antennas being shaped the same as, and in alignment with, their respective transmitter antennas.

7. A swept frequency detection system according to claim 1 wherein said transmitter antennas extend vertically on one side of an interrogation zone and said receiver antennas extend vertically on the opposite side of said interrogation zone and wherein a horizontal receiver antenna is positioned on the floor of said interrogation zone and is connected to one of said receiver antennas.

8. A swept frequency detection system according to claim 7 wherein said horizontal receiver antenna comprises two series connected loops of figure eight configuration with a crossover positioned between the loops.

9. A swept frequency dection system according to claim 8 wherein the crossover position of said figure-eight configuration is adjustable.

10. A swept frequency detection system for detecting resonant circuit targets attached to articles of merchandise present in an interrogation region, said targets being resonant, respectively, at different frequencies, said system comprising signal generating means for generating a plurality of swept frequency alternating electrical signals centered at different frequencies and swept together in synchronism, transmitter antena means arranged to receive said alternating electrical signals and to generate coresponding elecromagnetic waves in an interrogation region, and a receiver system arranged to detect disturbances to the electromagnetic waves produced by the presence, in the interrogation region, of a resonant circuit which is resonant within the frequency sweep of any of said alternating electrical signals and to generate an alarm in response to said detection.

11. A swept frequency detection system according to claim 10, wherein said transmitter antenna means comprises separate transmitter antennas arranged, respectively, to receive said alternating electrical signals centered at different frequencies.

12. A swept frequency detection system according to claim 10 wherein said signal generating means is arranged to control the frequency sweep of said alternating electrical signals such that they all increase and decrease in frequency together.

13. A swept frequency detection system for detecting resonant circuit targets attached to articles of merchandise located in an interrogation region, said targets being resonant, respectively, at different frequencies, said system comprising a plurality of variable frequency oscillators, each being responsive to an applied sweep signal to shift its output frequency in accordance therewith, each variable frequency oscillator having a different center frequency, a sweep signal generator connected to apply sweep signals simultaneously and in synchronism to said variable frequency oscillators, transmitter antenna means connected to the output of said variable frequency oscillators to generate corresponding electromagnetic waves in an interrogation region, and a receiver system arranged to detect disturbances to said electromagnetic waves produced by the presence in said interrogation region of a resonant circuit which is resonant at any of the frequencies produced by any of said variable frequency oscillators and to generate an alarm in response to said detection.

14. A swept frequency detection system according to claim 13 wherein said sweep signal generator is arranged to cause said variable frequency oscillators to produce output frequencies which increase and decrease together.

15. A swept frequency detection system according to claim 14 wherein said transmitter antenna means comprises a plurality of transmitter antennas, each connected to an associated variable frequency oscillator.

16. A swept frequency detection system according to claim 15 wherein said transmitter antennas are each in the form of a plurality of mutually offset loops extending along different diagonal lines.

17. A swept frequency detection system according to claim 13 wherein said system includes a plurality of interrogation zones with associated transmitter antenna means and wherein each of said variable frequency oscillators is connected to supply its output to transmitter antenna means in each of aid interrogation zones.

18. A swept frequency detection system for detecting resonant circuit targets attached to articles of merchandise in an interrogation region, said targets being resonant, respectively, at different frequencies, said system comprising a swept frequency signal generator, transmitter antenna means connected to receive signals, via a plurality of signal channels, from said swept frequency signal generator, a frequency converter connected along at least one of said signal channels to convert the frequencies received from said signal generator to frequencies different from the frequencies in the other signal channels while maintaining the frequencies swept together in synchronism and a receiver system arranged to detect disturbances to electromagnetic waves produced by the presence of a resonant circuit target in the vicinity of said transmitter antenna means and to generate an alarm in response to said detection.

19. A swept frequency detection system according to claim 18 wherein said frequency converter is a frequency divider.

20. A swept frequency detection system according to claim 18 wherein said swept frequency signal generator is a digital frequency generator.

21. A swept frequency detection system according to claim 18 wherein a frequency converter is provided in each of said channels.

22. A swept frequency detection system according to claim 18 wherein the outputs of each of said signal channels are applied to a common signal summer and wherein said antenna means is a single antenna converted to receive outputs from said summer.

23. A swept frequency detection system according to claim 18 wherein said system includes a plurality of interrogation zones with associated transmitter antennas means and plural signal channels and wherein said swept frequency signal generator is connected to the plural signal chanels in each interrogation zone.

24. A swept frequency detection system according to claim 18 wherein said transmitter antenna means is located on a wrap desk.

25. A swept frequency theft detection system for detecting resonant circuit targets attached to articles of merchandise located in an interrogation region, said targets being resonant, respectively, at different frequencies, said system comprising means for generating a plurality of swept frequency electrical signals each having a different center frequency, said signals all being swept in frequency simultaneously and in synchronism, a signal amplifier and summer connected to amplify and combine said electrical signals, a transmitter antenna connected to receive the amplified and combined electrical signals and to generate corresponding electromagnetic waves in an interrogation region, and a receiver system arranged to detect disturbances to said electromagnetic waves produced by the presence in said interrogation region of a resonant circuit which is resonant at a frequency within the frequency sweep of any of said swept frequency electrical signals, and to generate an alarm in response to such detection.

26. A swept frequency detection system according to claim 25, wherein the means for generating a plurality of swept frequency electrical signals comprises a common swept frequency signal generator, a plurality of signal channels connected between said signal generator and said antenna and a frequency converter connected to at least one of said signal channels.

27. A swept frequency detection system according to claim 25, wherein said transmitter antenna is located on a wrap desk.

* * * * *

UNITED STATES PATENT AND TRADEMARK OFFICE

CERTIFICATE OF CORRECTION

PATENT NO. : 4,870,391

DATED : September 26, 1989

INVENTOR(S) : MICHAEL N. COOPER

It is certified that error appears in the above-identified patent and that said Letters Patent is hereby corrected as shown below:

Title page:

AT [56] REFERENCES CITED

U.S. Patent Documents, "Wahlstron" should read --Wahlstrom--.

COLUMN 1

Line 59, "durathon" should read --duration--.

COLUMN 2

Line 25, "signal" should read --signals-- and "alarm re-" should read --alarm in re---.

COLUMN 3

Line 37, "store each patron" should read --store.--.
Line 38, "must pass through one of these aisles." should be deleted.
Line 47, "interrogating" should read --interrogation--.

COLUMN 4

Line 33, "addition" should read --addition,--.
Line 35, "8 MHZ" should read --2 MHZ--.
Line 37, "8 MHZ" should read --2 MHZ--.
Line 39, "ceived" should read --ceiver--.
Line 40, "44." should read --46.--.
Line 55, "FIG. 2" should read --FIG. 2,--.
Line 68, "Aislle" should read --Aisle--.

UNITED STATES PATENT AND TRADEMARK OFFICE

CERTIFICATE OF CORRECTION

PATENT NO. : 4,870,391

DATED : September 26, 1989

INVENTOR(S) : MICHAEL N. COOPER

It is certified that error appears in the above-identified patent and that said Letters Patent is hereby corrected as shown below:

COLUMN 5

Line 5, "attivated." should read --activated.--.
Line 18, "antenna panel 58" should read --antenna panel 22-.
Line 21, "above described" should read --above-described--.
Line 63, "76 and" should read --76, and--.

COLUMN 6

Line 22, "to input" should read --to an input--.
Line 64, "filter ampli-" should read --filter, ampli---.

COLUMN 7

Line 2, "filter am-" should read --filter, am---.
Line 31, "filter amplifier" should read --filter, amplifier--.
Line 34, "side on" should read --side or on--.
Line 38, "its" should be deleted.
Line 44, "20 and 44" should read --44 and 46--.
Line 61, "and" should read --on--.

COLUMN 8

Line 11, "loops 126" should read --loops 126a and 126b--.
Line 19, "MHZ loop 124" should read --MHZ loop 124b--.
Line 64, "exit. The" should read --exit. ¶ The--.

UNITED STATES PATENT AND TRADEMARK OFFICE

CERTIFICATE OF CORRECTION

PATENT NO. : 4,870,391

DATED : September 26, 1989

INVENTOR(S) : MICHAEL N. COOPER

It is certified that error appears in the above-identified patent and that said Letters Patent is hereby corrected as shown below:

COLUMN 9

Line 11, "46a and 46b" should read --42a and 42b--.
Line 18, "anetnna 44" should read --antenna 34--.
Line 23, "42a and 42b" should read --46a and 46b--.
Line 24, "that-electromagnetic" should read --that electromagnetic--.

COLUMN 10

Line 4, "loops 42a and 42b" should read --loops 40a and 40b--.
Line 9, "inducance" should read --inductance--.
Line 11, "2 MHZ" should read --2 MHZ.--.
Line 16, "antenna 44" should read --antenna 44,--.
Line 21, "40a and 40b" should read --32a and 32b--.
Line 58, "then" should read --than--.
Line 60, "shown" should read --shows--.

COLUMN 11

Line 13, "a" should read --an--.
Line 17, "sweep" should read --sweeps--.
Line 50, "MHZ filter amplifier" should read --MHX filter, amplifier--.

COLUMN 12

Line 2, "ceeding" should read --ceding--.
Line 37, "target" should read --targets--.
Line 62, "produces" should read --produced--.

UNITED STATES PATENT AND TRADEMARK OFFICE

CERTIFICATE OF CORRECTION

PATENT NO. : 4,870,391

DATED : September 26, 1989

INVENTOR(S) : MICHAEL N. COOPER

It is certified that error appears in the above-identified patent and that said Letters Patent is hereby corrected as shown below:

COLUMN 13

Line 31, "figure eight" should read --figure-eight--.
Line 33, "dection" should read --detection--.
Line 43, "antena" should read --antenna--.
Line 45, "coresponding elecromagnetic" should read --corresponding electromagnetic--.

COLUMN 14

Line 33, "aid" should read ---said--.
Line 68, "nas" should read --na--.

COLUMN 15

Line 2, "chanels" should read --channels--.

COLUMN 16

Line 12, "said antenna" should read --said transmitter antenna--.

Signed and Sealed this

Sixteenth Day of April, 1991

*Attest:*

HARRY F. MANBECK, JR.

*Attesting Officer*

*Commissioner of Patents and Trademarks*